US009322370B2

(12) United States Patent
von Krane et al.

(10) Patent No.: US 9,322,370 B2
(45) Date of Patent: Apr. 26, 2016

(54) HAND-HELD WORK IMPLEMENT HAVING AN INTERNAL COMBUSTION ENGINE AND AN AIR FILTER

(71) Applicant: Andreas Stihl AG & Co. KG, Waiblingen (DE)

(72) Inventors: Florian von Krane, Kirchberg (DE); Steffen Rögele, Benningen (DE)

(73) Assignee: ANDREAS STIHL AG & CO. KG, Waiblingen (DE)

( * ) Notice: Subject to any disclaimer, the term of this patent is extended or adjusted under 35 U.S.C. 154(b) by 23 days.

(21) Appl. No.: 13/898,517

(22) Filed: May 21, 2013

(65) Prior Publication Data

US 2013/0306018 A1 Nov. 21, 2013

(30) Foreign Application Priority Data

May 21, 2012 (DE) ..... 10 2012 010 584

(51) Int. Cl.

| | |
|---|---|
| ***F02B 77/04*** | (2006.01) |
| ***F02B 25/00*** | (2006.01) |
| ***F02M 35/10*** | (2006.01) |
| ***F02M 35/02*** | (2006.01) |
| ***F02M 35/024*** | (2006.01) |
| *F02B 63/02* | (2006.01) |

(52) U.S. Cl.

CPC ..... *F02M 35/10144* (2013.01); *F02M 35/0207* (2013.01); *F02M 35/02483* (2013.01); *F02M 35/1017* (2013.01); *F02B 63/02* (2013.01)

(58) Field of Classification Search

CPC .... F02B 2075/025; F02B 33/04; F02B 25/22; F02B 25/00; F02B 2700/37; F02B 77/13; F02B 63/02; F02B 27/02; F02M 35/024; F02M 35/10321; F02M 35/10144; F02M 35/112; F02M 35/12

USPC ..... 123/73 PP, 65 R, 198 E, 184.21, 184.53

See application file for complete search history.

(56) References Cited

U.S. PATENT DOCUMENTS

| | | | | |
|---|---|---|---|---|
| 5,935,281 | A * | 8/1999 | Rotheiser et al. | 55/385.3 |
| 7,090,204 | B2 * | 8/2006 | Zwimpfer et al. | 261/46 |
| 7,228,825 | B2 * | 6/2007 | Hoche et al. | 123/73 PP |
| 7,806,953 | B2 * | 10/2010 | Schlauch | 55/385.1 |
| 2001/0032609 | A1 * | 10/2001 | Taylor | 123/184.21 |
| 2006/0146920 | A1 * | 7/2006 | Suh et al. | 375/221 |

FOREIGN PATENT DOCUMENTS

DE 10 2004 056 149 A1 5/2006

* cited by examiner

*Primary Examiner* — Lindsay Low
*Assistant Examiner* — Syed O Hasan
(74) *Attorney, Agent, or Firm* — Paul D. Strain, Esq.; Strain & Strain PLLC

(57) ABSTRACT

A hand-held working implement comprises an internal combustion engine, an air filter, and an intermediate flange, wherein the intermediate flange is arranged between the air filter and the internal combustion engine, wherein the bottom of the intermediate flange is arranged opposite the air filter bottom, wherein the air filter bottom and the intermediate flange bound an interior space, wherein the interior space comprises a portion of the duct, wherein a portion of the duct in the interior space is bounded by at least one boundary wall which protrudes into the interior space transversely with respect to the air filter bottom, wherein the boundary wall is formed integrally on the intermediate flange and/or on the air filter bottom, and wherein the boundary wall bridges the spacing between the air filter bottom and the bottom of the intermediate flange.

18 Claims, 4 Drawing Sheets

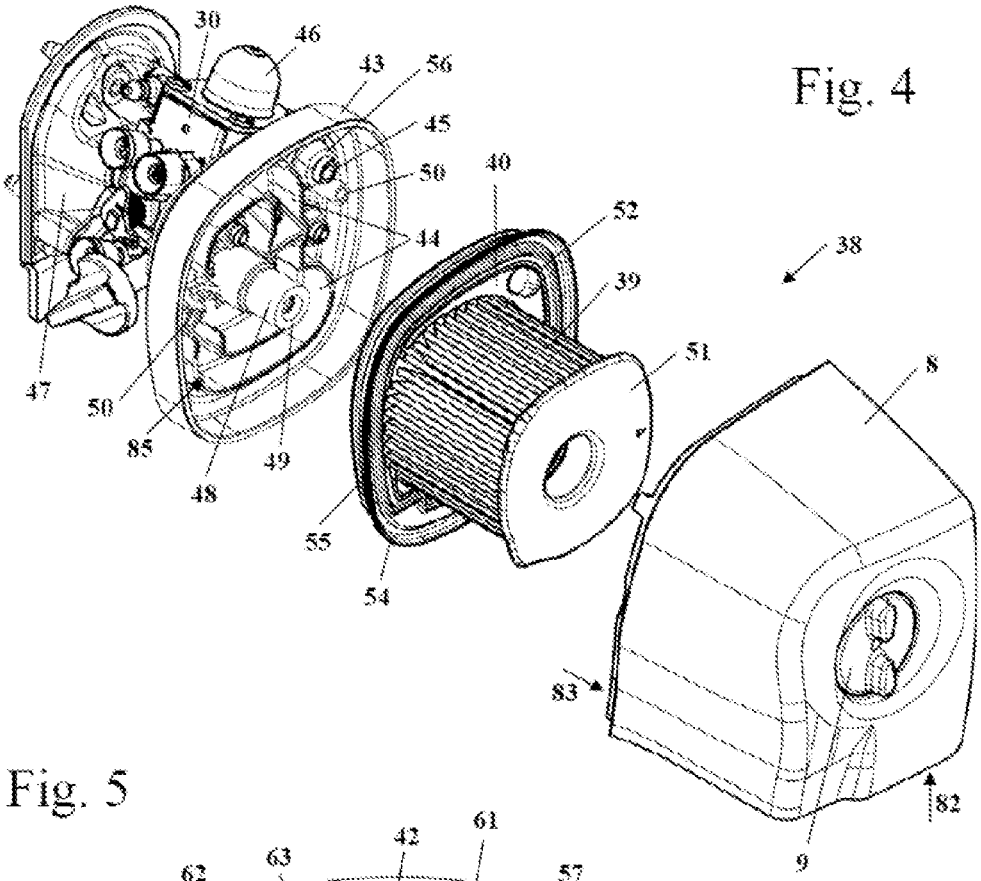
Fig. 4
Fig. 5
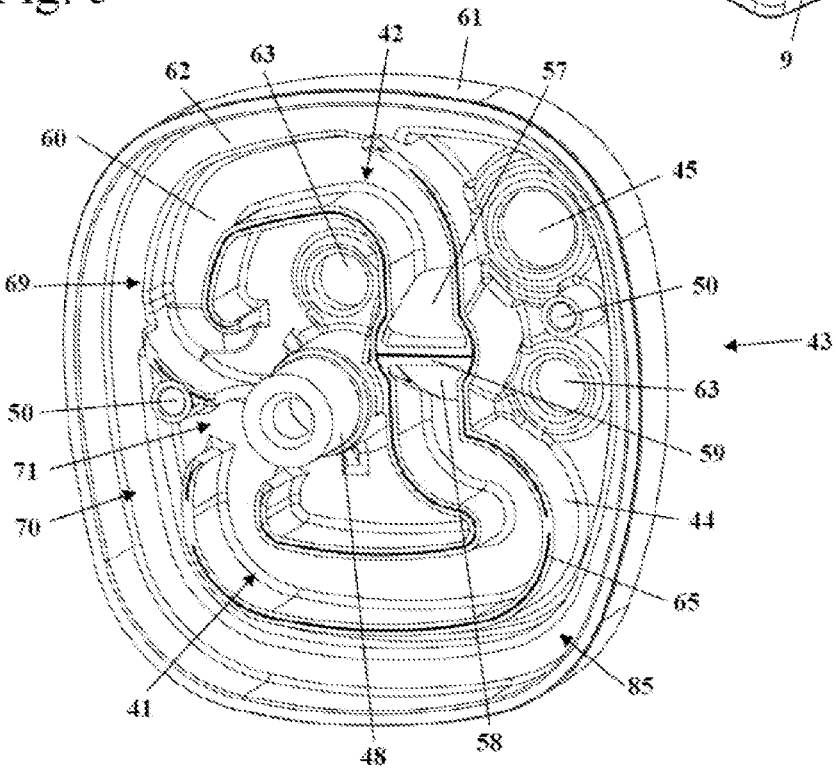

HAND-HELD WORK IMPLEMENT HAVING AN INTERNAL COMBUSTION ENGINE AND AN AIR FILTER

CROSS-REFERENCE TO RELATED PATENT APPLICATIONS

This application is based upon and claims the benefit of priority from prior German Patent Application No. DE 10 2012 010 584.3, filed May 21, 2012, the entire contents of which are incorporated herein by reference in their entirety.

BACKGROUND

The application relates to a hand-held work implement having an internal combustion engine and having an air filter.

DE 10 2004 056 149 A1 has disclosed an internal combustion engine, namely a two-stroke engine for a hand-held work implement, in which internal combustion engine the air duct and the mixture duct are extended into the pure space of the air filter. In order to avoid mixture being sucked into the air duct, the lengths of mixture duct and air duct are adapted to one another. The ducts are guided in the air filter bottom and are separated from the filter element by an intermediate wall.

SUMMARY OF PREFERRED EMBODIMENTS

A preferred embodiment of the present application provides a hand-held work implement having an internal combustion engine and an air filter, in which the hand-held work implement has a simple construction and satisfactory emissions values.

One particular embodiment comprises a hand-held work implement comprising an internal combustion engine, an air filter, wherein the air filter comprises a filter element which is connected fixedly at its front-side ends to end plates, wherein the filter element is cylindrical, wherein the filter element and the end plates create a separation between a dirty side and a pure side of the air filter, wherein the pure side of the air filter is connected via a duct to the internal combustion engine, and wherein a first end plate is configured as an air filter bottom, and an intermediate flange, wherein the intermediate flange is arranged between the air filter and the internal combustion engine, wherein the bottom of the intermediate flange is arranged opposite the air filter bottom, wherein the air filter bottom and the intermediate flange bound an interior space, wherein the interior space comprises a portion of the duct, wherein a portion of the duct in the interior space is bounded by at least one boundary wall which protrudes into the interior space transversely with respect to the air filter bottom, wherein the boundary wall is formed integrally on the intermediate flange and/or on the air filter bottom, and wherein the boundary wall bridges the spacing between the air filter bottom and the bottom of the intermediate flange.

Another embodiment further comprises an air duct and a mixture duct, wherein the lengths of air duct and mixture duct are independently set such that the pressure waves which are produced in the mixture duct and in the air duct during operation of the hand-held work implement oscillate with the same phase.

In yet another embodiment, it is provided that the at least one duct is guided in the interior space which is formed between the intermediate flange and the air filter bottom. As a result of the fact that the duct is guided in the intermediate flange, only a small amount of installation space is required, and the available installation space can be utilized satisfactorily. As a result of the fact that the end plate on the filter element at the same time forms the air filter bottom and delimits the air duct and the mixture duct in the interior space, only a small number of components are required. Here, the boundary wall is formed integrally on at least one of the components of air filter bottom and intermediate flange. The filter element is cylindrical here. Accordingly, the wall of the filter element is formed by parallel straight lines which run between two flat faces, namely a bottom face and a top face. The bottom face of the filter element can be, for example, circular or oval. Other bottom faces, for example triangular, rectangular or polygonal bottom faces, can also be advantageous, however.

In a further embodiment, the pure side of the air filter is advantageously connected via a mixture duct and an air duct to the internal combustion engine. Here, the mixture duct is a duct, into which at least one fuel opening opens. In particular, a section of the air duct and a section of the mixture duct are guided in the interior space. As a result of the fact that the air duct and mixture duct are guided in the interior space, the duct lengths of air duct and mixture duct can be adapted in a simple way such that the pressure waves which are produced during operation in the mixture duct and in the air duct oscillate with the same phase. As a result, an intake of fuel into the air duct can be largely avoided. Satisfactory emissions values are achieved as a result.

In still another embodiment, it can also be advantageous that the pure side of the air filter is connected only via one duct to the internal combustion engine. The section of the duct which is guided in the interior space advantageously acts as a resonance pipe. The duct can also be configured as a mixture duct, the length of the mixture duct being adapted in such a way that the result is a defined vacuum at a fuel opening which opens into the mixture duct. By adaptation of the length of the mixture duct, the phase position of the pressure wave which is formed in the mixture duct during operation can be set in such a way that a desired phase position, for example a maximum vacuum, results at the fuel opening. As a result, a sufficient supply of fuel to the internal combustion engine can be achieved in a simple way.

In a further embodiment, the at least one duct, and in particular an air duct and a mixture duct, is advantageously delimited exclusively by elements which are connected fixedly to the intermediate flange and/or the filter element. As a result, only two components, namely the filter component and intermediate flange, are required to form the duct sections in the interior space which is delimited by air filter bottom and intermediate flange. At least one boundary wall is advantageously formed integrally on the intermediate flange. In particular, all boundary walls are formed integrally on the intermediate flange. This results in a simple construction of the filter component which is composed of the filter element and the end plates which are connected fixedly thereto. During the exchange of the filter element, the boundary walls are not also exchanged.

In yet a further embodiment, at least one seal is advantageously molded on the air filter bottom, which seal bears against the intermediate flange and seals the interior space. A separate sealing element can be omitted as a result. As a result of the fact that the seal is molded on the air filter bottom, the seal is also exchanged during the exchange of the filter element. As a result, reliable sealing of the interior space and of the pure side of the air filter, which pure side is connected to the interior space, is achieved over the entire service life of the work implement as a result.

In still another embodiment, a particularly satisfactory sealing action is achieved if two seals are molded on the air filter bottom, a first seal bearing against the intermediate flange in a direction transversely with respect to the longitudinal center axis of the filter element and a second seal bearing against the intermediate flange in the direction of the longitudinal center axis of the filter element. Both seals are advantageously composed of the same material and are molded onto the air filter bottom in one work operation. This results in simple, inexpensive production. The intermediate flange advantageously has a circumferential step, against which a seal bears. As a result, the seal can be of comparatively small configuration and the air filter bottom can be of flat configuration. As a result of the step, nevertheless, a sufficient width is achieved for the ducts which are guided in between air filter bottom and intermediate flange, namely the air duct and the mixture duct. The step ensures a defined sealing location. The step is simple to clean, with the result that a reliable sealing action can be achieved. This is advantageous, in particular, during the filter change and during the checking of the filter element. A seal advantageously forms a duct wall of air duct and/or mixture duct. This results in a simple construction, and the length of the required boundary walls can be kept low.

In still yet a further embodiment intermediate flange advantageously has a circumferential edge, into which the air filter bottom is pushed at least partially. Here, the air filter bottom is advantageously prefixed in the edge, in particular via the at least one seal, with the result that the air filter can be mounted simply on the intermediate flange.

In another embodiment, in order to achieve a satisfactory sealing action of air duct and mixture duct in the interior space between intermediate flange and air filter bottom, it is provided that, on an end side, at least one boundary wall has a web which engages between two webs of a component which adjoins the end side. In the case of a boundary wall which is formed integrally on the intermediate flange, the component which adjoins the end side is the air filter bottom and, in the case of a boundary wall which is formed integrally on the air filter bottom, the component which adjoins the end side is the intermediate flange. It can be provided that a section of a boundary wall is formed integrally on the intermediate flange and a section, adjoining on the end side, of the boundary wall is formed integrally on the air filter bottom. In this case, all the webs are formed on the boundary walls which lie adjacently with respect to one another on the end side. The webs act in the manner of a labyrinth seal and make a sufficiently satisfactory sealing action possible of the at least one duct, in particular of air duct and mixture duct with a simple design and without additional components. Here, the webs can be produced from dimensionally stable plastic. This results in simplified production in comparison with the embodiment of a molded seal made from an elastic plastic. The air duct and mixture duct have to be largely sealed, in order that the entire length of those sections of air duct and mixture duct which are guided in the interior space is active as duct length. As a result, satisfactory adaptation of the duct lengths is made possible.

In yet a further embodiment, in order to fasten the filter element, a fastening element is advantageously provided which protrudes through the filter element. In order to seal the pure side of the air filter with respect to the surroundings, a third seal is advantageously molded on the second end plate of the filter element, which third seal bears against a fastening dome which is formed on the intermediate flange. The fastening element for the air filter cover protrudes through the third seal. The third seal advantageously bears against the fastening dome on the end side. Tolerances can be compensated for on account of the elastic configuration of the seal. When the filter element is tightened, a defined contact pressure of the third seal and therefore an effective sealing action can be ensured. The first, the second and the third seal are advantageously composed of the same material and are molded onto the air filter bottom in the same work operation. This results in simple, inexpensive production.

In a further embodiment, the air duct and the mixture duct advantageously run in the interior space in an imaginary plane which lies transversely with respect to the longitudinal center axis of the filter element, in particular perpendicularly with respect to the longitudinal center axis of the filter element. As a result, a small amount of installation space is required for the extended ducts, and the available installation space can be utilized satisfactorily. Here, the imaginary plane is a plane which separates air duct and mixture duct over their entire length. The imaginary plane advantageously separates the ducts approximately centrally.

In still another embodiment, a mixture duct opening for the mixture duct and an air duct opening for the air duct are advantageously configured on the intermediate flange. The mixture duct opening and the air duct opening are separated from one another, in particular, by a dividing wall. This prevents that a cross flow of fuel into the air duct can take place directly at the opening of the ducts on the intermediate flange. The air filter bottom is of closed configuration in the region which lies opposite the mixture duct opening and the air duct opening. In this region, the air filter bottom acts as a splash pot, in particular at the mixture duct, and prevents fuel droplets which are entrained in the mixture duct being capable of being hurled into the air filter and to the filter element on account of the pulsating pressure waves in the mixture duct. The air filter bottom advantageously has a passage opening which connects both the mixture duct and the air duct to the pure side of the air filter. The air duct and mixture duct are accordingly advantageously no longer separated from one another at the connection to the pure side of the air filter, but rather are guided together. On account of the duct length which is guided in the interior space of the intermediate flange, fuel which is entrained in the mixture duct has already substantially been deposited on the duct walls of the mixture duct, with the result that a cross flow of fuel into the air filter is avoided. The fuel which is deposited on the duct walls is entrained by the combustion air which is sucked into the internal combustion engine and is discharged to the internal combustion engine.

In still another embodiment, in order to ensure a defined intake of air to the dirty side of the air filter, it is provided that a sealing web is molded on the air filter bottom on the side which faces away from the intermediate flange. A circumferential wall of the air filter cover bears against the sealing web. The sealing web seals the dirty side of the air filter on the air filter bottom with respect to the surroundings. As a result, an intake of surrounding air in the region of the air filter bottom is avoided. The circumferential wall of the air filter cover advantageously has openings which are arranged in regions which are loaded with low polluting loads during operation of the work implement. As a result, low dirt contamination of the air which is sucked into the air filter is achieved in a simple way. As a result, the intervals for cleaning the filter element are extended.

In another further embodiment, the mixture duct and the air duct are advantageously guided over a part of their length in an intake duct of a carburetor. The intake duct in the carburetor advantageously has at least partially a round cross section. As a result, the carburetor can be produced simply. Here, the intake duct is divided in the carburetor via a dividing wall into the air duct and the mixture duct. The air duct and mixture duct are advantageously controlled by a common throttle element, in particular by a throttle valve. As a result, the coupling of the throttle element for the air duct to the throttle element for the mixture duct can be omitted, which results in a simplified construction and a small requirement for installation space. The intermediate flange is advantageously arranged directly on the carburetor. The intermediate flange is advantageously fixed on fastening screws, by way of which the carburetor is held.

Further objects, features, and advantages of the present application will become apparent form the detailed description of preferred embodiments which is set forth below, when considered together with the figures of drawing.

BRIEF DESCRIPTION OF THE DRAWINGS

Exemplary embodiments will be explained using the drawings, in which:

FIG. 4 shows an exploded illustration of air filter and intermediate flange of the blowing device, FIG. 5 shows a perspective view of the intermediate flange.

DETAILED DESCRIPTION OF PREFERRED EMBODIMENTS

Figure 1:
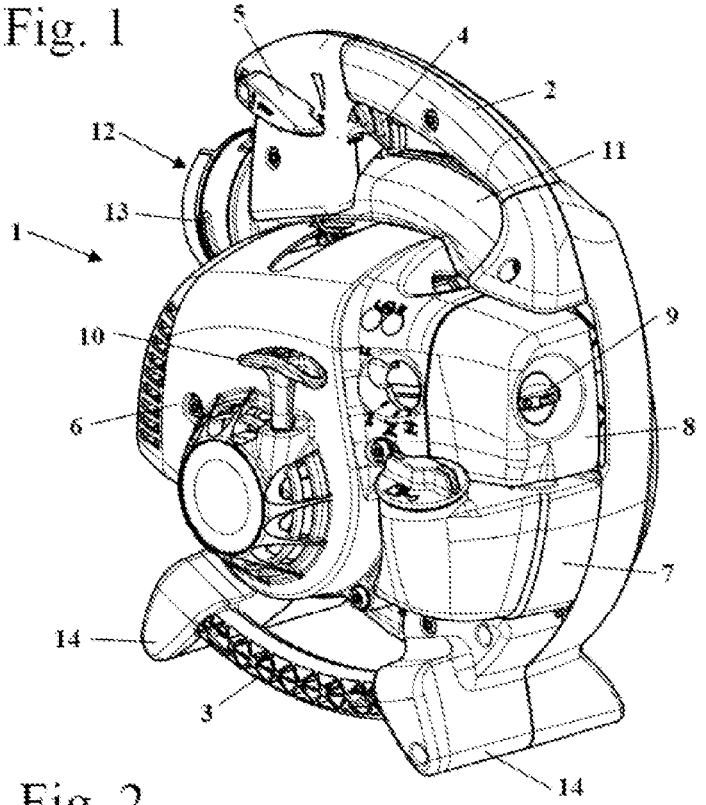
FIG. 1 shows a perspective illustration of a blowing device.

FIG. 1 shows a portable blowing device 1 as an exemplary embodiment for a hand-held work implement. The blowing device 1 has a handle 2 and an additional handle 3 which is arranged so as to lie opposite the former. In usual operation, the blowing device 1 is held on the upper handle 2. However, the blowing device 1 can also be held so as to lie horizontally, in particular during suction operation. To this end, the operator can hold the handle 2 with one hand and the additional handle 3 with the other hand. A hand throttle 4 is mounted pivotably on the handle 2. Adjacently to the handle 2, the blowing device 1 has an actuating element 5, by way of which, for example, a stop for the hand throttle 4 and therefore the blowing performance can be set.

The blowing device 1 has a housing 6, in which a drive motor (not shown in FIG. 1) is arranged. The drive motor is configured as an internal combustion engine 15 (FIG. 2) and can be started via the starter handle 10 (shown in FIG. 1) of a cable pull starting device (not shown in detail). A fuel tank 7 which is arranged on the housing 6 serves to supply the internal combustion engine 15 with fuel. Moreover, the blowing device 1 has an air filter cover 8 which is held on the blowing device 1 by way of a closure element 9 which can be released by the operator. The internal combustion engine 15 delivers an air flow through a fan spiral 11. The fan spiral 11 has an air outlet opening 12. Fastening webs 13 for fixing a blowing pipe are formed on the outer circumference of the fan spiral 11 adjacently with respect to the air outlet opening 12. The blowing device 1 has standing feet 14 for parking purposes. The additional handle 3 is fixed on the standing feet 14.

Figure 2:
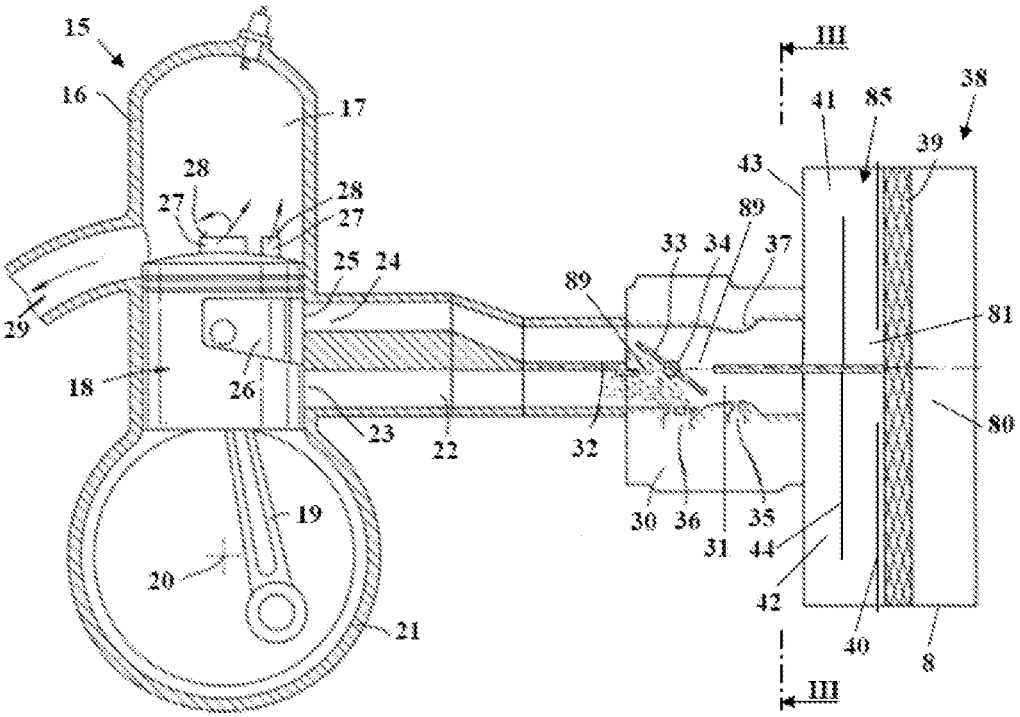
FIG. 2 shows a diagrammatic illustration of the internal combustion engine of the blowing device from FIG. 1.

FIG. 2 shows the construction of the internal combustion engine 15 in detail. Here, the illustration in FIG. 2 is diagrammatic and greatly simplified. The internal combustion engine 15 is configured as a single-cylinder two-stroke engine and has a cylinder 16, in which a combustion chamber 17 is formed. The combustion chamber 17 is delimited by a piston 18 which is mounted in the cylinder 16 so as to move to and fro. Via a connecting rod 19, the piston 18 drives a crankshaft 20 which is mounted rotatably in a crankcase 21. The crankshaft 20 drives a fan wheel (not shown) which delivers the air flow through the fan spiral 11 (FIG. 1).

The internal combustion engine 15 is supplied with fuel-air mixture via a mixture duct 22 and combustion air which is largely free of fuel via an air duct 24. It can also be provided that lean mixture is supplied via the air duct 24. Whether combustion air which is largely free of fuel or lean mixture is supplied via the air duct 24 can be dependent on the operating state of the internal combustion engine.

The mixture duct 22 opens with a mixture inlet 23 which is port-controlled by the piston 18 into the interior space of the crankcase 21. During the upward stroke of the piston 18, the mixture inlet 23 is opened and fuel/air mixture is sucked into the crankcase 21. The air duct 24 opens with an air inlet 25 on the cylinder 16. On opposite sides, the internal combustion engine 15 advantageously has in each case one air inlet 25. The piston 18 has at least one piston pocket 26. In the region of the bottom dead center (shown in FIG. 2) of the piston 18, the interior space of the crankcase 21 is connected via crossflow ducts 27 to the combustion chamber 17. The crossflow ducts 27 open with crossflow windows 28 which are port-controlled by the piston 18 into the combustion chamber 17. In the region of the top dead center of the piston 18, the piston pocket 26 connects the air inlet 25 to the crossflow windows 28. Here, combustion air which is low in fuel or largely free of fuel is advanced in the crossflow ducts 27.

During the following downward stroke of the piston 18, the crossflow windows 28 from the piston 18 toward the combustion chamber 17 are opened. First of all, the combustion air which is low in fuel or largely free of fuel flows from the crossflow ducts 27 into the combustion chamber 17 and flushes exhaust gases from the preceding engine cycle through an outlet 29 which leads out of the combustion chamber 17. Subsequently, fresh fuel/air mixture flows from the crankcase 21 via the crossflow ducts 27 into the combustion chamber 17. During the following upward stroke of the piston 18, the mixture in the combustion chamber 17 is compressed and is ignited in the region of the top dead center of the piston 18. The combustion of the fuel/air mixture in the combustion chamber 17 accelerates the piston 18 in the direction of its bottom dead center. The piston 18 first of all opens the outlet 29 which is likewise port-controlled by the piston 18. The exhaust gases escape through the outlet 29 into an exhaust gas silencer (not shown) which is arranged at the outlet 29. As soon as the crossflow windows 28 open, the remaining exhaust gases are flushed out of the combustion chamber 17 through the outlet 29 by the combustion air which is low in fuel or free of fuel and flows in from the crossflow ducts 27.

Figure 3:
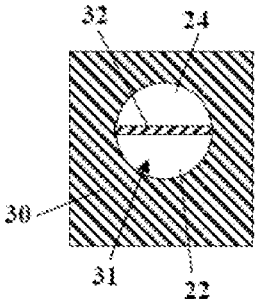
FIG. 3 shows a diagrammatic section along the line III-III in FIG. 2.

The combustion air is sucked in via an air filter 38 and a carburetor 30. The air filter 38 has a filter element 39 and an air filter bottom 40. The filter element 39 separates a dirty side 80 from a pure side 81 of the air filter 38. The air filter bottom 40 is arranged on an intermediate flange 43 which for its part is arranged on the carburetor 30. The intermediate flange 43 is arranged in the flow path between the air filter 38 and the internal combustion engine 15. The intermediate flange 43 is advantageously also arranged spatially between the air filter 38 and the internal combustion engine 15. An intake duct 31 which, as FIG. 3 shows, has a round cross section is formed in the carburetor 30. The intake duct 31 is divided by a dividing wall 32 into the mixture duct 22 and the air duct 24. A throttle valve 33 with a throttle shaft 34 is mounted pivotably in the carburetor 30. Another design of the throttle element, for example as a rotatable roller, can also be provided. The throttle element controls both the free flow cross section of the air duct 24 and the free flow cross section of the mixture duct 22. A choke element, for example a choke flap, can be arranged in the intake channel 31 upstream of the throttle valve 33. In relation to the flow direction in the intake duct 31, the dividing wall 32 extends both upstream and downstream of the throttle valve 33.

As FIG. 2 shows, in the case of a partially open throttle valve 33, openings 89 are formed between the throttle valve 33 and the adjacent dividing wall 32, through which openings 89 the fuel can pass from the mixture duct 22 into the air duct 24. It can also be provided that the dividing wall 32 extends as far as the throttle shaft 34. Narrow slots can then also be provided between the dividing wall 32 and throttle shaft 34. A complete sealing action between the dividing wall 32 and throttle shaft 34 is complicated and therefore not expedient. The fuel is supplied via the main fuel opening 35 which is arranged at a venturi 37 of the carburetor 30 and via auxiliary fuel openings 36 which open into the mixture duct 22. On account of pressure differences between the mixture duct 22 and the air duct 24, in particular in the case of a negative pressure of the air duct 24 with respect to the mixture duct 22, for example in the region of the openings 89, fuel or mixture can pass into the air duct 24. This may be undesirable depending on the operating state. At part load, the openings 89 are not closed by the throttle valve 33. At full load, although the throttle valve 33 bears against the dividing wall 32, it optionally does not seal the openings 89 completely, as a complete sealing action of the openings 89 at full load is complicated in structural terms. Regardless, at full load, that is to say when the throttle valve 33 is completely open, passage of fuel into the air duct 24 via the leaks between the throttle valve 33 and the dividing wall 32 is to be avoided.

In order to avoid the passage of fuel into the air ducts 24, the lengths of mixture duct 22 and air duct 24 are adapted to one another in such a way that the result is a higher pressure in the air duct 24 than in the mixture duct 22 in the region of the throttle valve 33. This can be carried out by adaptation of the phase position and the amplitude of the pressure waves. The duct lengths are advantageously adapted to one another in such a way that the pressure waves which are produced during operation in the air duct and in the mixture duct oscillate with the same phase. The pressure waves are influenced firstly via the control times of the ducts, that is to say the instants, at which the mixture inlet 23 and the air inlet 25 are opened by the piston 18, and secondly by the lengths of mixture duct 22 and air duct 24. In order to adapt the duct lengths, the air duct 24 and the mixture duct 22 are extended into the intermediate flange 43. With the air filter bottom 40, the intermediate flange 43 delimits an interior space 85, in which a section 41 of the air duct 24 and a section 42 of the mixture duct 22 are guided. The sections 41 and 42 of air duct 24 and mixture duct 22 are delimited by the intermediate flange 43, the air filter bottom 40 and by one or more boundary walls 44 which are shown diagrammatically in FIG. 2. Here, the boundary walls 44 are formed integrally on the intermediate flange 43 or on the air filter bottom 40, with the result that no additional components are required. In one alternative to the diagrammatic illustration in FIG. 2, the boundary walls 44 are advantageously oriented parallel and not perpendicularly with respect to the longitudinal axis of the intake duct 31. This results in an arrangement which saves installation space, and the demolding of air filter bottom 40 and intermediate flange 43 during the production in a casting process is simplified.

As FIG. 4 shows, the carburetor 30 is held between a fastening flange 47, which is advantageously fixed on the cylinder 16 of the internal combustion engine 15, and the intermediate flange 43. The carburetor 30 has a flushing pump 46, by way of which a control chamber of the carburetor 30 can be flushed before starting of the internal combustion engine 15. The carburetor 30 is configured as a diaphragm carburetor and has a compensation space, by way of which a reduced pressure on the pure side of the air filter 38, for example as a result of increasing contamination of the filter element 39, is taken into consideration during the metering of fuel. The compensation space is connected to the pure side of the air filter 38 via a compensator connection 45 which is formed on the intermediate flange 43. In the exemplary embodiment, the compensator connection 45 is guided through a sealing plug 56 which prevents surrounding air at the compensator connection 45 from entering into the interior space 85 of the intermediate flange 43.

In the exemplary embodiment which is shown, the intermediate flange 43 is configured as a separate component. However, the intermediate flange 43 can also be formed integrally on other components, for example on an operating medium tank such as the fuel tank of the work implement.

In a central region, the intermediate flange 43 has a fastening dome 48, on the inside of which a sealing face 49 is formed. A plurality of boundary walls 44 which are formed integrally on the intermediate flange 43 protrude into the interior space 85. Moreover, the intermediate flange 43 has two positioning receptacles 50 for positioning the air filter bottom 40 with respect to the intermediate flange 43.

The filter element 39 is configured as a round filter, to be precise as a finned filter and is connected in a fixed and sealing manner on its end sides with end plates. Here, as shown in the exemplary embodiment, the round filter can have a circular cross section. However, the round filter can also have an oval cross section. Other cross-sectional shapes may also be advantageous. The end plate which faces the intermediate flange 43 forms the air filter bottom 40. An end plate 51 is arranged on the opposite end side. A first seal 54 and a second seal 55 are formed integrally on the air filter bottom 40. The air filter bottom 40 is advantageously composed of plastic, in particular a dimensionally stable plastic such as polypropylene. The seals 54 and 55 are advantageously composed of an elastic material such as rubber or an elastomer and are molded on the air filter bottom 40. The air filter bottom 40 and the end plate 51 with all molded seals are advantageously molded onto the filter element 39 in an injection molding process. All the molded seals are advantageously composed of the same material and are molded onto the air filter bottom 40 and the end plate 51 in one work operation. This results in simple production. However, the air filter bottom 40 and the end plate 51 can also be connected sealingly to the filter element 39 in another way, for example by adhesive bonding. The filter element 39 forms a structural unit which can be exchanged simply together with the air filter bottom 40 and the end plate 51.

FIG. 4 shows arrows 82 and 83 which diagrammatically indicate the intake directions into the air filter 38. As FIG. 1 shows in conjunction with FIG. 4, the intake takes place from regions within the housing 6 and not from the outer side of the blowing device 1. The contamination with pollutant load is lower in the interior of the housing 6. At the same time, it is avoided that dirt which is swirled up by the blowing air stream passes directly into the air filter 38.

As FIG. 4 also shows, the filter assembly comprising the filter element 39 with the air filter bottom 40 and the end plate 51 is arranged on the intermediate flange 43 without the interposition of further components. The sections 41 and 42 of mixture duct 22 and air duct 24 may be formed exclusively by the air filter 38, namely the air filter bottom 40 and the seal 55, and the intermediate flange 43. This results in a simple construction and a low number of required components.

Figure 8:
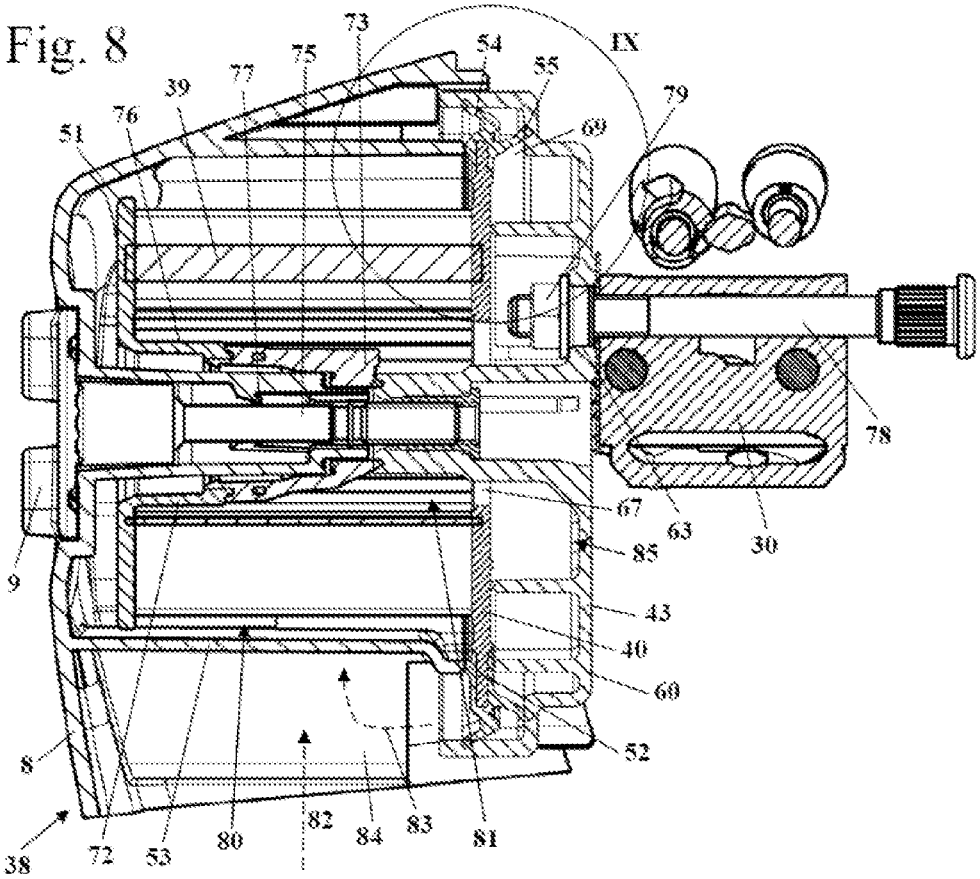
FIG. 8 shows a section through the arrangement from FIG. 7 with an air filter cover arranged thereon.

As FIG. 5 shows, the sections 41 and 42 are guided in the intermediate flange 43 approximately in a C-shaped manner. The mixture duct 22 enters into the interior space 85 at a mixture duct opening 57 and the air channel 24 enters at an air channel opening 58. The mixture duct opening 57 and the air duct opening 58 are arranged immediately next to one another and are separated from one another by a dividing wall 59. The dividing wall 59 forms an extension of the dividing wall 32. The mixture duct opening 57 and the air duct opening 58 are arranged approximately in a central region of the C which is formed by the sections 41 and 42. The fastening dome 48 is arranged centrally in the C. The compensator connection 45, which is shown without the sealing plug 56 in FIG. 5, and two fastening openings 63 for connecting the intermediate flange 43 to the carburetor 30 are arranged outside the sections 41 and 42. An intermediate space 70 which is part of the interior space 85 is formed outside the sections 41 and 42. The intermediate space 70 is connected to the mixture duct 22 and the air duct 24 via a connecting opening 71 which is arranged in the region of the ends of the sections 41 and 42. Moreover, the section 42 of the mixture duct 22 is delimited over part of its length not by a boundary wall 44, but rather by a step 62 which is formed on the outer circumference of the intermediate flange 43. The step 62 does not extend over the entire width of the intermediate flange 43. A connecting opening 69 between the section 42 of the mixture duct 22 and the intermediate space 70 is formed on the step 62. As FIG. 8 shows, the seal 55 delimits the section 42 of the mixture duct 22 in the region of the connecting opening 69. Here, the seal 55 delimits the section 42 on part of its length. The compensator connection 45 also opens into the intermediate space 70. As FIG. 5 also shows, the boundary walls 44 have a narrow web 65 on their end side, the function of which narrow web 65 will be described in further detail in the following text.

Figure 6:
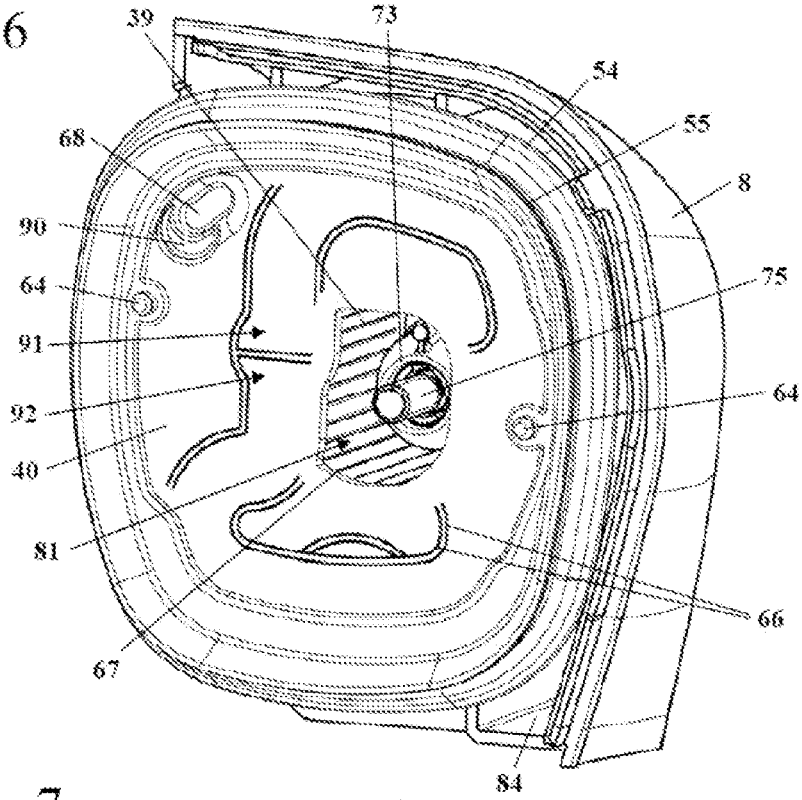
FIG. 6 shows a perspective view of the air filter bottom of the air filter.
Figure 9:
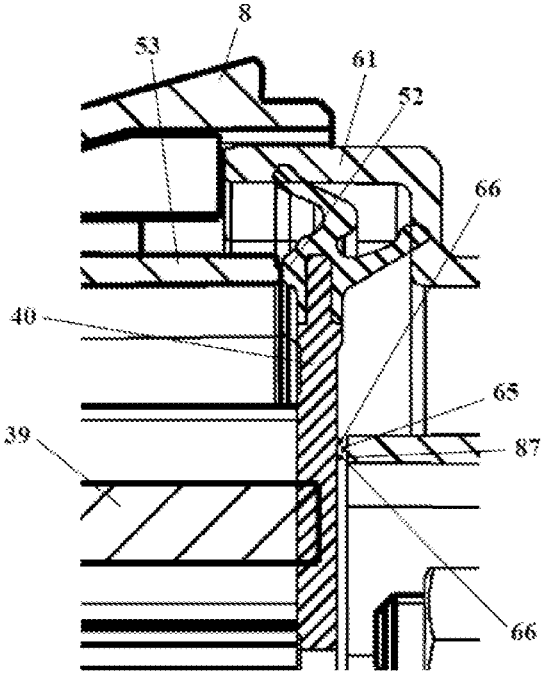
FIG. 9 shows the detail IX from FIG. 8 in an enlarged illustration.

As FIG. 5 also shows, the intermediate flange 43 has a bottom 60 which is oriented approximately perpendicularly with respect to the longitudinal center axis 86 (shown in FIG. 7) of the filter element 39. Moreover, the intermediate flange 43 has a circumferential edge 61 which runs approximately parallel to the longitudinal center axis 86. The step 62 extends between the bottom 60 and the edge 61 and is likewise configured so as to be circumferential around the bottom 60. FIG. 6 shows the air filter bottom 40. Two positioning journals 64 which protrude into the positioning receptacles 50 (FIG. 5) of the intermediate flange 43 are arranged on the air filter bottom 40. Moreover, the air filter bottom 40 has a depression 68, in the region of which the compensator connection 45 opens. The depression 68 fixes the sealing plug 56 on a section 90. The connection of the compensator connection 45 into the interior space 85 is ensured adjacently to the section 90 via the depression 68. As FIG. 6 also shows, narrow webs 66 are formed integrally on the air filter bottom 40, the course of which narrow webs 66 corresponds to the course of the webs 65. As FIG. 9 shows, when the air filter bottom 40 is pushed into the intermediate flange 43, each web 65 protrudes between two webs 66 and forms with the latter a labyrinth seal. Here, the web 65 is arranged on an end side 87 of the boundary wall 44. This achieves a satisfactory sealing action of the sections 41 and 42 of air duct 24 and mixture duct 22, and minor production tolerances which influence the insertion depth of the air filter bottom 40 into the intermediate flange 43 can be compensated for. Here, the height of the webs 65 and 66 is advantageously less than approximately 2 mm, in particular from approximately 0.2 mm to approximately 1 mm.

As FIG. 6 also shows, the air filter bottom 40 has a passage opening 67 which connects both the section 41 of the air duct 24 and the section 42 of the mixture duct 22 to the pure side 81 of the filter element 39. Accordingly, the mixture duct 22 and the air duct 24 merge jointly onto the pure side 81 of the air filter 38 at the passage opening 67. FIG. 6 also shows the fastening screw 75, by way of which the air filter cover 8 is fixed on the intermediate flange 43. The seal 73 which will be described in further detail in the following text is molded on the end plate 51, through which seal 73 the fastening screw 75 protrudes.

As FIG. 6 shows, the air filter bottom 40 has a region 91 which is arranged so as to lie opposite the mixture duct opening 57, and a region 92 which is arranged so as to lie opposite the air duct opening 58. The air filter bottom 40 is of closed configuration in the regions 91 and 92. The regions 91 and 92 act as deflector wall for fuel which is entrained in the mixture duct 22 or in the air duct 24. The fuel is deposited at the regions 91 and 92 and can be transported by combustion air which is sucked in back to the carburetor 30 and to the internal combustion engine 15. This avoids it being possible for fuel to pass through the passage opening 67 to the filter element 39. As FIG. 6 also shows, the regions 91 and 92 are arranged immediately adjacently to the passage opening 67, which results in a compact construction. The regions 91 and 92 are separated from the passage opening 67 by a boundary wall 44, with the result that the passage of fuel from the regions 91 and 92 to the passage opening 67 is avoided.

Figure 7:
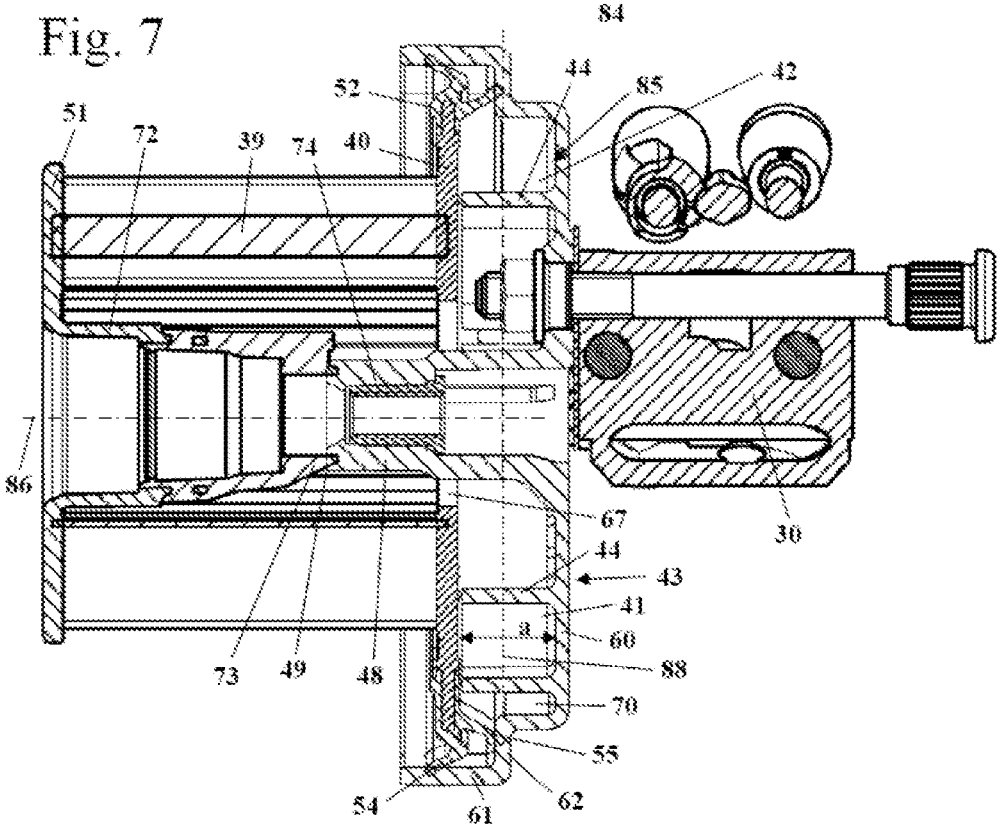
FIG. 7 shows a section through filter element, intermediate flange and carburetor.

As FIG. 7 shows, the end plate 51 has a pipe stub 72 which is formed integrally on the end plate 51 and protrudes into the interior of the filter element 39. The seal 73 is molded circumferentially on the pipe stub 72 as a soft component made from an elastic material, for example an elastomer. The seal 73 bears against the sealing face 49 of the fastening dome 48. During tightening of the fastening screw 75 (FIG. 6), the seal 73 is deformed. FIG. 7 shows the seal 73 in the non-deformed state and the latter therefore overlaps with the fastening dome 48.

The intermediate flange 43 is advantageously composed of plastic. In order to fix the fastening screw 75, a threaded bush 74 is advantageously inserted into the intermediate flange 43, in particular is encapsulated by injection molding by the intermediate flange 43. However, the intermediate flange 43 can also be composed of metal, in particular of aluminum. In this case, a thread can be cut directly into the fastening dome 48. The embodiment of the intermediate flange 43 from metal aids the heat dissipation and, as a result, prevents excessive heating of the carburetor 30. This is advantageous, in particular, in the case of internal combustion engines 15, at the outlet 29 of which an exhaust gas silencer is arranged which operates with a catalytic converter and develops a large amount of heat during operation.

As FIG. 7 also shows, the intermediate flange 43 has a spacing a from the air filter bottom 40 in the region, in which the sections 41 and 42 are guided by the mixture duct. The boundary walls 44 extend substantially over the entire spacing a, merely a narrow gap being formed between the boundary wall 44 and the air filter bottom 40, in order to compensate for tolerances. This gap is bridged by the webs 65 and 66 (FIG. 9).

FIG. 7 also shows the arrangement of the seals 54 and 55. The seal 54 protrudes to the outside transversely with respect to the longitudinal center axis 86 of the filter element 39 and bears against the edge 61, that is to say against the circumferential wall of the intermediate flange 43. The seal 54 therefore seals in the radial direction. The seal 55 bears against the step 62, that is to say against a wall which runs transversely, in particular approximately perpendicularly, with respect to the longitudinal center axis 86. The seal 55 therefore seals in the direction of the longitudinal center axis 86. The step 62 forms a defined sealing location and can be cleaned satisfactorily, with the result that a satisfactory sealing effect is achieved. Since the seals 54 and 55 lie downstream of one another in the flow path between the dirty side of the air filter 38 and the interior space 85, a satisfactory sealing action is achieved. The seals 54 and 55 are also shown in the non-deformed state in FIG. 7 and therefore overlap with the intermediate flange 43.

As FIG. 7 also shows, the interior space 85 extends substantially in a plane 88 perpendicularly with respect to the longitudinal center axis 86. Here, the plane 88 is the plane which divides the sections 41 and 42 of mixture duct 22 and air duct 24 approximately centrally between the bottom 60 of the intermediate flange 43 and the air filter bottom 40. The sections 41 and 42 run only in one plane, with the result that the sections 41 and 42 which are formed in the intermediate flange 43 are divided completely by the plane 88. FIG. 2 shows the course of the sections 41 and 42 in a simplified and only diagrammatic manner.

As FIG. 8 shows diagrammatically, the intake of air into the air filter 38 takes place in the direction of an arrow 82 and, in the position (shown in FIG. 1) of the blowing device 1, from below. Here, the intake takes place in front of the sectional plane in FIG. 8, for which reason the arrow 82 is shown in dashed form. In the case of the arrangement (shown in FIG. 1) of the blowing device 1, the intake of a further air flow takes place horizontally from the front along an arrow 83 into a duct 84 which is formed on the air filter cover 8 and opens onto the dirty side 80 of the air filter 38. The duct 84 is also shown in FIG. 6. FIG. 8 also shows the fastening screw 75 which is connected fixedly to the closure element 9 so as to rotate with it and which penetrates the seal 73. As FIG. 8 shows, a captive securing means 77 is formed integrally on the air filter cover 8, which captive securing means 77 can be, for example, of approximately hook-shaped configuration and holds the fastening screw 75 on the air filter cover 8. The captive securing means 77 is formed integrally on a pipe stub 76 of the air filter cover 8, which pipe stub 76 engages into the pipe stub 72 of the end plate 51 on the filter element 39. Moreover, FIG. 8 shows one of the two fastening screws 78 which are held fixedly in terms of rotation in the fastening flange 47 (shown in FIG. 4) and penetrate the carburetor 30 and the bottom 60 of the intermediate flange 43. Here, the fastening screw 78 protrudes through the fastening opening 63. A nut 79 which fixes the intermediate flange 43 and the carburetor 30 is screwed onto the fastening screw 78.

FIGS. 8 and 9 also show the contact of a circumferential wall 53 of the air filter cover 8 with a sealing web 52 which is formed integrally on the air filter bottom 40. The sealing web 52 is formed integrally outside the filter element 39 on that side of the air filter bottom 40 which lies so as to face away from the intermediate flange 43. The sealing web 52 ensures that the surrounding air can enter into the dirty side 80 of the air filter 38 only along the arrows 82 and 83 from structurally predetermined regions.

It can also be provided to form at least one section of a boundary wall integrally on the air filter bottom 40. It can also be provided to divide the boundary wall 44 at least over a part length perpendicularly with respect to the longitudinal center axis 86 of the filter element 39 and to form in each case one part of the boundary wall 44 integrally on the air filter bottom 40 and the opposite part integrally on the intermediate flange 43. In these arrangements, the engagement into one another of the webs 65 and 66 (shown in FIG. 9) is also advantageous. Here, a web 65 is formed integrally on a boundary wall 44 which is formed integrally on the intermediate flange 43, and webs 66 are formed integrally on a boundary wall which is formed integrally on the air filter bottom 40 and is arranged adjacently on the end side.

The foregoing description of preferred embodiments of the invention has been presented for purposes of illustration and description only. It is not intended to be exhaustive or to limit the invention to the precise form disclosed, and modifications and variations are possible and/or would be apparent in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto and that the claims encompass all embodiments of the invention, including the disclosed embodiments and their equivalents.

The invention claimed is:

1. A hand-held work implement comprising an internal combustion engine, an air filter, wherein the air filter comprises a filter element which is connected in a fixed manner on its end sides to end plates, wherein the filter element is cylindrical, wherein the filter element and the end plates create a separation between a dirty side and a pure side of the air filter, wherein the pure side of the air filter is connected via a duct to the internal combustion engine, and wherein a first end plate is configured as an air filter bottom, and an intermediate flange, wherein the intermediate flange is arranged between the air filter and the internal combustion engine, wherein the bottom of the intermediate flange is arranged opposite the air filter bottom, wherein the air filter bottom and the intermediate flange bound an interior space, wherein the interior space comprises a portion of the duct, wherein a portion of the duct in the interior space is bounded by at least one boundary wall which protrudes into the interior space transversely with respect to the air filter bottom, wherein the boundary wall is formed integrally on the intermediate flange and/or on the air filter bottom, wherein the boundary wall bridges the spacing between the air filter bottom and the bottom of the intermediate flange, wherein at least two seals are molded on the air filter bottom, wherein the two seals bear against the intermediate flange and seal the interior space, wherein a first seal bears against the intermediate flange in a transverse direction with respect to the longitudinal center axis of the filter element and seals in the radial direction, wherein a second seal bears against the intermediate flange in the direction of the longitudinal center axis and seals in the direction of the longitudinal center axis, wherein the first seal and second seal are designed as sealing lips, wherein the air filter bottom is composed of a dimensionally stable plastic, wherein the first seal and the second seal are composed of an elastic material, wherein the first seal and second seal are connected and are injection molded on the air filter bottom.

2. The hand-held work implement according to claim 1, wherein at least one boundary wall is formed integrally on the intermediate flange.

3. The hand-held work implement according to claim 1, wherein the intermediate flange comprises a circumferential step, wherein one of the at least two seals bears against the circumferential step.

4. The hand-held work implement according to claim 1, wherein one of the at least two seals bounds a portion of the wall of the duct.

5. The hand-held work implement according to claim 1, wherein the intermediate flange comprises a circumferential edge, wherein the air filter bottom is pushed at least partially into the intermediate flange.

6. The hand-held work implement according to claim 1, wherein a first web is arranged on the boundary wall, wherein two further webs are arranged on a component adjacent to the top of the boundary wall, wherein the two further webs follow the path of the boundary wall, and wherein the first web arranged at the boundary wall engages between the two webs arranged adjacent to the top of the boundary wall so that the first web and the two further webs form a labyrinth seal.

7. The hand-held work implement according to claim 1, further comprising a second end plate, wherein a third seal is molded on a second end plate, wherein the third seal bears against a fastening dome which is formed on the intermediate flange, and wherein a fastening element of an air filter cover protrudes through the third seal.

8. The hand-held work implement according to claim 1, wherein the pure side of the air filter is connected via an air duct and a mixture duct to the internal combustion engine, wherein a portion of the air duct and a portion of the mixture duct are arranged in the interior space, and wherein the mixture duct comprises at least one fuel opening for feeding fuel into the mixture duct.

9. The hand-held work implement according to claim 8, wherein the air duct and the mixture duct are arranged independently in a single plane of the interior space, wherein the plane lies transversely with respect to the longitudinal center axis of the filter element.

10. The hand-held work implement according to claim 8, further comprising a mixture duct opening arranged on the intermediate flange through which the mixture duct is guided, further comprising an air duct opening arranged on the intermediate flange through which the air duct is guided, wherein a dividing wall separates the mixture duct opening and the air duct opening.

11. The hand-held work implement according to claim 10, wherein the air filter bottom comprises a closed configuration in the regions which lie opposite the mixture duct opening and the air duct opening.

12. The hand-held work implement according to claim 8, wherein the air filter bottom comprises a passage opening which connects both the mixture duct and the air duct to the pure side of the air filter.

13. The hand-held work implement according to claim 8, wherein a portion of the mixture duct and a portion of the air duct are arranged in an intake duct of a carburetor, wherein the intake duct in the carburetor comprises an at least partially round cross section divided by a dividing wall, wherein the dividing wall divides the mixture duct and the air duct.

14. The hand-held work implement according to claim 13, wherein the intermediate flange is arranged on the carburetor.

15. The hand-held work implement according to claim 1, wherein a third seal is molded on the air filter bottom on the side which faces away from the intermediate flange, wherein a circumferential wall of an air filter cover bears against the third seal, and wherein the third seal seals the dirty side of the air filter on the air filter bottom with respect to the surroundings.

16. The hand-held work implement according to claim 1, further comprising an air duct and a mixture duct, wherein the lengths of air duct and mixture duct are independently set such that the pressure waves which are produced in the mixture duct and in the air duct during operation of the hand-held work implement oscillate with the same phase.

17. The hand-held work implement according to claim 8, wherein the lengths of air duct and mixture duct are independently set such that the pressure waves which are produced in the mixture duct and in the air duct during operation of the hand-held work implement oscillate with the same phase.

18. A hand-held work implement comprising an internal combustion engine, an air filter, wherein the air filter comprises a filter element which is connected in a fixed manner on its end sides to end plates, wherein the filter element is cylindrical, wherein the filter element and the end plates create a separation between a dirty side and a pure side of the air filter, wherein the pure side of the air filter is connected via a duct to the internal combustion engine, and wherein a first end plate is configured as an air filter bottom, and an intermediate flange, wherein the intermediate flange is arranged between the air filter and the internal combustion engine, wherein the bottom of the intermediate flange is arranged opposite the air filter bottom, wherein the air filter bottom and the intermediate flange bound an interior space, wherein the interior space comprises a portion of the duct, wherein a portion of the duct in the interior space is bounded by at least one boundary wall which protrudes into the interior space transversely with respect to the air filter bottom, wherein the boundary wall is formed integrally on the intermediate flange and/or on the air filter bottom, wherein the boundary wall bridges the spacing between the air filter bottom and the bottom of the intermediate flange, wherein at least three seals are molded on the air filter bottom, wherein a first seal and a second seal bear against the intermediate flange and seal the interior space, wherein the first seal bears against the intermediate flange in a transverse direction with respect to the longitudinal center axis of the filter element and seals in the radial direction, wherein the second seal bears against the intermediate flange in the direction of the longitudinal center axis and seals in the direction of the longitudinal center axis, wherein the first and second seals are designed as sealing lips, wherein the third seal is molded on the air filter bottom on the side which faces away from the intermediate flange, wherein a circumferential wall of an air filter cover bears against the third seal, wherein the third seal seals the dirty side of the air filter on the air filter bottom with respect to the surroundings, wherein the air filter bottom is composed of a dimensionally stable plastic, wherein the first seal, the second seal, and the third seal are formed from a common sealing element composed of an elastic material which has a U-shaped cross-section, wherein the first seal, the second seal, and the third seal are connected at the edge of the air filter bottom, wherein the first seal, the second seal, and the third seal are are injection molded on the air filter bottom.

* * * * *